US011306901B2

(12) United States Patent
Jeswani et al.

(10) Patent No.: US 11,306,901 B2
(45) Date of Patent: Apr. 19, 2022

(54) INTERNET OF THINGS ADAPTABLE DOWNLIGHT

(71) Applicant: LEDVANCE LLC, Wilmington, MA (US)

(72) Inventors: Anil Jeswani, Acton, MA (US); Ahmed Eissa, Cambridge, MA (US); Renaud Richard, Manchester, NH (US); Janet Milliez, Cambridge, MA (US); Valeriy Zolotykh, Abington, MA (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 17/183,443

(22) Filed: Feb. 24, 2021

(65) Prior Publication Data

US 2021/0180778 A1 Jun. 17, 2021

Related U.S. Application Data

(63) Continuation of application No. 16/884,618, filed on May 27, 2020, now Pat. No. 10,962,206, which is a (Continued)

(51) Int. Cl.

| | |
|---|---|
| ***F21V 21/04*** | (2006.01) |
| ***F21V 23/00*** | (2015.01) |
| ***F21S 8/02*** | (2006.01) |
| ***F21V 23/04*** | (2006.01) |
| *F21Y 115/10* | (2016.01) |

(52) U.S. Cl.

CPC ..... *F21V 21/04* (2013.01); *F21S 8/026* (2013.01); *F21V 23/009* (2013.01); *F21V 23/0435* (2013.01); *F21Y 2115/10* (2016.08)

(58) Field of Classification Search

CPC .... F21V 21/04; F21V 23/009; F21V 23/0435; F21V 23/003; F21V 23/002; F21V 15/01; F21S 8/026

See application file for complete search history.

(56) References Cited

U.S. PATENT DOCUMENTS

| | | | | |
|---|---|---|---|---|
| 9,557,021 | B2 * | 1/2017 | Madden | F21V 29/70 |
| 2001/0040804 | A1 * | 11/2001 | Marquardt | F21K 9/00 362/240 |

(Continued)

*Primary Examiner* — Donald L Raleigh
(74) *Attorney, Agent, or Firm* — Tutunjian & Bitetto PC

(57) ABSTRACT

A luminaire that includes a housing having a downlight geometry and containing a light engine including light emitting diodes (LEDs), in which the light engine is positioned to emit light through a light emission end of the housing. The housing contains driver electronics for controlling power received by the luminaire for powering the light engine. An access opening on a back surface of the housing exposes the driver electronics. A junction box supporting at least a portion of a wireless control module. The junction box having an electrical pathway opening is engaged to the back surface of the housing. The wireless control module is contained in the knockout of the junction box. Electrical communication between the wireless control module and the driver circuit is across a physical electrically conductive pathway that extends through the electrical pathway opening of the junction box.

20 Claims, 12 Drawing Sheets

Related U.S. Application Data continuation of application No. 16/415,653, filed on May 17, 2019, now Pat. No. 10,711,983.

(56) References Cited

U.S. PATENT DOCUMENTS

| | | | | |
|---|---|---|---|---|
| 2011/0006688 | A1* | 1/2011 | Shim | F21V 29/763 315/119 |
| 2017/0307181 | A1* | 10/2017 | Engle | F21V 29/507 |
| 2017/0307198 | A1* | 10/2017 | Shah | F21V 5/04 |
| 2018/0328552 | A1* | 11/2018 | Meir | F21S 2/00 |
| 2019/0212003 | A1* | 7/2019 | Lazear | F21V 21/30 |

* cited by examiner

INTERNET OF THINGS ADAPTABLE DOWNLIGHT

CROSS REFERENCE TO RELATED APPLICATION

This patent application is a Continuation and claims benefit and priority to U.S. patent application Ser. No. 16/884,618, titled "INTERNET OF THINGS ADAPTABLE DOWNLIGHT", filed May 27, 2020, which claims benefit and priority to U.S. Pat. No. 10,711,983, titled "INTERNET OF THINGS ADAPTABLE DOWNLIGHT" granted on Jul. 14, 2020, which are herein incorporated by reference in their entirety.

TECHNICAL FIELD

The present disclosure generally relates to luminaire assemblies employing light emitting diodes as the light source. More specifically, the present disclosure relates to downlights employing light emitting diodes as the light source.

BACKGROUND

One of the most common light fixtures is the recessed can downlight (RCD) or Non-IC type fixtures, which is an open bottom can that contains a light bulb, most commonly an incandescent bulb or a fluorescent bulb. The fixture is typically connected to the power mains at 120 to 277 volts, 50/60 Hz. RCDs or Non-IC are generally installed during the construction of a building before the ceiling material (such as plaster or gypsum board) is applied. Therefore, they are not easily removed or substantially reconfigured during their lifetime. Recently, lighting devices have been developed that make use of light emitting diodes (LEDs) for a variety of lighting applications. Owing to their long lifetime and high energy efficiency, integrated LED luminaires are now also designed for replacing traditional incandescent and fluorescent luminaires, i.e., for retrofit applications and/or new construction features. For retrofit applications, the LED fixture is adapted to fit into existing fixture in ceiling. For new construction, the LED luminaire can be directly installed into the ceiling or installed with a new non-IC fixture.

SUMMARY

In one aspect, a luminaire is provided that includes a housing having a downlight geometry and a light engine including light emitting diodes (LEDs), in which the light engine is positioned to emit light through a light emission end of the housing having the downlight geometry. The housing contains driver electronics for controlling power received by the luminaire for powering the light engine. The luminaire includes an access opening on a back surface of the housing, in which the access opening exposes the driver electronics. A junction box for engaging a wireless control module and an electrical pathway opening is engaged to the back surface of the housing. The wireless control module is contained in the junction box, wherein electrical communication between the wireless control module is across a physical electrically conductive pathway that extends through the electrical pathway opening into connection with the driver circuit.

In another embodiment, a luminaire is provided that includes a housing and a light engine including at light emitting diodes (LEDs), in which the light engine is positioned to emit light through a light emission end of the housing. The housing contains driver electronics for controlling power received by the luminaire for powering the light engine. The luminaire includes an access opening on a back surface of the housing, in which the access opening exposes the driver electronics. A junction box having a knockout for engaging a wireless control module and a wiring opening is reversibly engaged to the back surface of the housing. The wireless control module is reversibly contained in the knockout of the junction box, wherein electrical communication between the wireless control module is by wiring that extends from the wireless control module through the wiring opening to the driver circuit.

In another aspect, a method of adding wireless control to a luminaire is provided. In one embodiment, the method includes exposing driver circuitry through a back surface of a housing for a luminaire having a downlight geometry, wherein the housing contains a light engine is positioned to emit light through a light emission end of the housing. The driver electronics controls power received by the luminaire for powering the light engine. A junction box for engaging a wireless control module and a wiring opening is engaged to the back surface of the housing. Wiring from the wireless control module is connected to the driver electronics and the wireless control module, in which the wiring passes through the wiring opening of the junction box.

BRIEF DESCRIPTION OF THE DRAWINGS

The following description will provide details of embodiments with reference to the following figures wherein.

DETAILED DESCRIPTION

Figure 1:
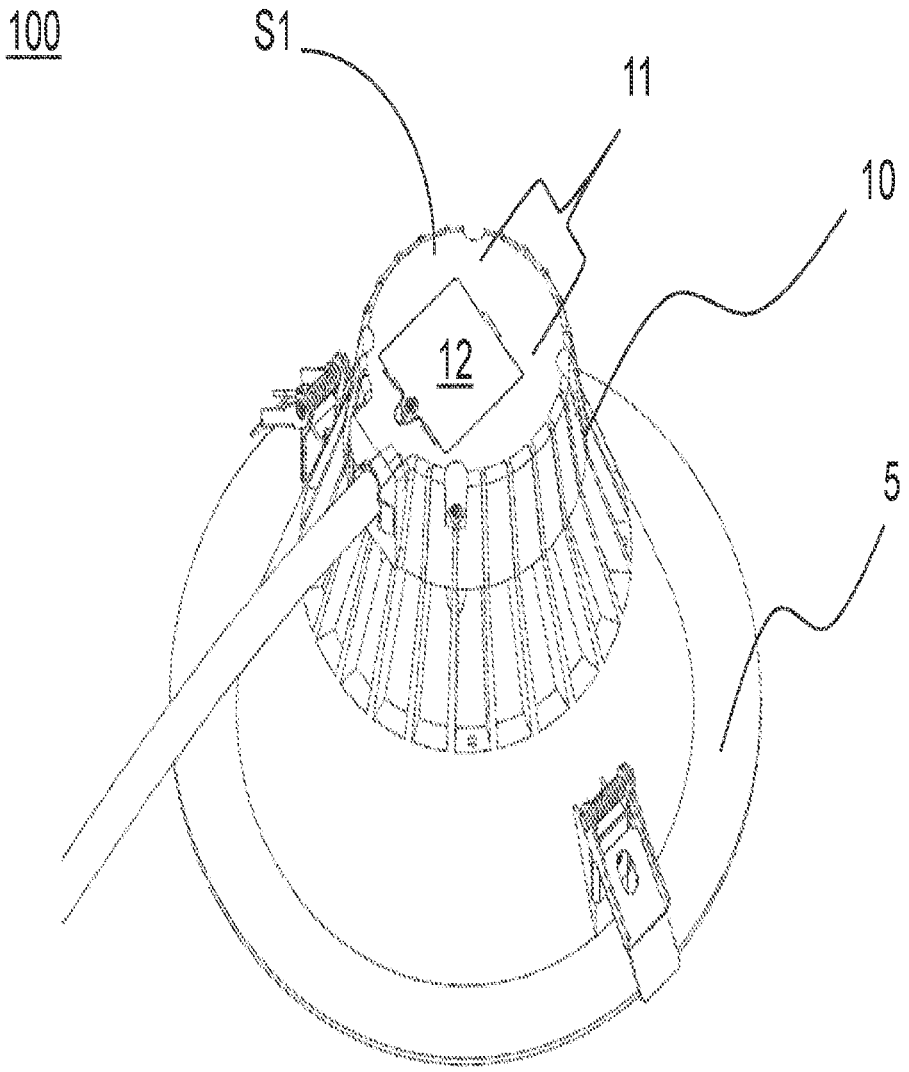
FIG. 1 is a perspective view of luminaire design including a housing having an access panel to the driver electronics of the luminaire, wherein removal of the access panel on a back surface of a downlight housing allows for reversable engagement of a junction box for engagement of a wireless control module housed to the junction box in electrical communication with the driver electronics of the luminaire, in accordance with one embodiment of the present disclosure.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

In some embodiments, the present disclosure provides a downlight that can be equipped with a smart wireless controller for both new construction and retrofit applications, making it IoT (Internet of Things) ready. In some embodiments, the designs described herein can provide the installer the ability to decide, i.e., give the installer the option, if they would like for a downlight to have a wireless controller providing the light with smart control functionality, or the installer may forgo installing a wireless controller. This can provide to the user the ability with this design to both install a downlight having wireless controllers for smart like functions during new construction, e.g., the initial installation, or to retrofit a downlight that previously did not include the wireless capability at the time on its initial installation. The installer may convert the downlight to include the wireless controller on site. For example, the conversions parts can be standard parts that can be stocked at the installer. In other examples, the user can procure the downlight with the wireless controller already installed in the downlight, which allows for a made to order business model.

Downlights that do not include the conversion design of the present disclosure are wirelessly controlled with integrated drivers with having their own, e.g., dedicated unit, wireless communication module. This can unnecessarily increase the cost of the downlight, especially when wireless controls are not necessary for the use of the light. Additionally, when the wireless controls are integrated with the driver circuitry for the downlight this also requires a different driver for each communication protocol. When the communication protocol for the downlight needs to be changed, in a downlight that includes the wireless controller being integrated into the driver circuitry, conversion to a different communication protocol can result in a full fixture replacement. Another alternative to enable wireless control is to use a smart dimming module that is installed at the junction box for the power line input of the downlight. These are specific to the ecosystem of their vendor, and they require the available room and access at the junction box for this install.

The methods and structures of the present disclosure provide a plug&play approach, in which a commercially available wireless control module can be added to a downlight fixture to turn it into internet of things (IoT) ready device. The methods and structures of the present disclosure also provide flexibility in the selection of the communication technology, as well as flexibility in the upgrading of communication technology, e.g., changing the communication protocols to the device. In some embodiments, by using commercial modules, multiple technologies can be used, by changing module model. Upgrades can also be made to inventory by using updated modules, adding a future proof element to the inventory.

The designs provided herein can introduce internet of things (IoT) functionality, such as wireless controls, to a downlight while keeping the same operation characteristic for the regular downlight. Additionally, the plug and play designs of the present disclosure can maintain the smaller form factor as a standard downlight.

The downlight/luminaire structures of the present disclosure are now described with greater detail with reference to FIGS. 1-11B. In some embodiments, a downlight/luminaire 100 is provided including a housing 10 having a downlight geometry and containing a light engine 60 including light emitting diodes (LEDs) 50, in which the light engine 60 is positioned to emit light through a light emission end of the housing 10. In some embodiments, the housing 10 contains driver electronics 200 (the driver electronics 200 are interchangeably referred to as the driver circuit 200) for controlling power received by the luminaire 100 for powering the light engine 60. The housing 10 includes an access opening 11 on a back surface S1 of the housing 10 that exposes the driver electronics 200. In some embodiments, a junction box 30 having a knockout 31 for engaging a wireless control module 40 and an electrical pathway opening 32 is engaged to the back surface S1 of the housing 10. In some embodiments, the wireless control module 40 is contained in the knockout 31 of the junction box 30. In one example, electrical communication between the wireless control module 40 and the driver electronics 200 is across a physical electrically conductive pathway that extends through the electrical pathway opening 32 into connection with the driver circuit 200.

FIGS. 1-3 and 6-10B depict one embodiment of a downlight 100 including a light engine 60 having a plurality of solid-state light emitters, e.g., light emitting diodes (LEDs) 50. A "downlight", or recessed light, (also pot light in Canadian English, sometimes can light (for canister light) in American English) is a light fixture that is installed into a hollow opening in a ceiling. When installed it appears to have light shining from a hole in the ceiling, concentrating the light in a downward direction as a broad floodlight or narrow spotlight. "Pot light" or "canister light" implies the hole is circular and the lighting fixture is cylindrical, like a pot or canister. The downlight/luminaire 100 geometry of the present disclosure may also be rectangular. Broadly, there are three parts to a downlight fixture: 1) housing, 2) trim and 3) light engine. It is noted that this is not an exclusive list of the elements of a downlight fixture. The trim 5 is the visible portion of the downlight. The trim 5 is the insert that is seen when looking up into the fixture, and also includes the thin lining around the edge of the light. The housing 10 is the fixture itself that is installed inside the ceiling. It is noted that embodiments are contemplated in which the trim 5 and the housing 10 are integrated together in one piece, and there are embodiments in which the trim 5 and the housing 10 are separate components. There are many different types of light engines 60 that can be inserted into recessed lighting fixtures, i.e., downlights 100. In accordance with the embodiments of the present disclosure, the light engines 60 applicable to the methods and structures described herein include solid state emitters, such as light emitting diodes (LEDs) 50.

The housing 10 may be composed of a metal, such as aluminum (Al), which provides for heat dissipation of any heat produced by the light engine 60. In some embodiments, to provide for increased heat dissipation, a plurality of ridges or fin structures may be integrated into the aluminum housing 10. In some embodiments, the housing 10 may also be composed of a plastic, such a polycarbonate. The construction of the housing 10 may fall into one of four categories for downlights that are recognized in North America. For example, the housing may be constructed for IC or "insulation contact" rated new construction housings are attached to the ceiling supports before the ceiling surface is installed. If the area above the ceiling is accessible these fixtures may also be installed from within the attic space. IC housings are typically required wherever insulation will be in direct contact with the housing. Non-IC rated new construction housings are used in the same situations as the IC rated new construction housings, only they require that there be no contact with insulation and at least 3 in (7.6 cm) spacing from insulation. These housings are typically rated up to 150 watts. IC rated remodel housings are used in existing ceilings where insulation will be present and in contact with the fixture. Sloped-ceiling housings are available for both insulated and non-insulated ceilings that are vaulted. It is noted that the housing 10 of the downlight of the present disclosure may meet be designed to meet the requirements of any of the aforementioned standards. The housing 10 is typically designed to ensure that no flammable materials come into contact with the hot lighting fixture.

The housing 10 may be dimensioned to be available in various sizes based on the diameter of the circular opening where the downlight 100 is installed. In some examples, the circular opening of the housing 10 may be sized in 4, 5 and 6 inch diameter. It is noted that these dimensions are provided for illustrative purposes only and are not intended to limit the present disclosure. For example, the housing 10 may also have a circular opening in diameters equal to 2 inches or 3 inches. As noted above, the housing 10 may also be square or rectangular in geometry.

In some embodiments, the housing 10 can also be "Air Tight", which means it will not allow air to escape into the ceiling or attic, thus reducing both heating and cooling costs.

The trim 5 of the downlight 100 is selected to increase the aesthetic appearance of the luminaire. In some embodiments, the trim 5 may be a baffle that is black or white in color. In some embodiments, the trim 5 is made to absorb extra light and create a crisp architectural appearance. There are cone trims which produce a low-brightness aperture. In some embodiment, the trim 5 may be a multiplier that is designed to control the omnidirectional light from the light engine. Lens trim is designed to provide a diffused light and protect the luminaire. Lensed trims are normally found in wet locations. The luminous trims combine the diffused quality of lensed trim but with an open down light component. Adjustable trim allows for the adjustment of the light whether it is eyeball style, which protrudes from the trim or gimbal ring style, which adjusts inside the recess.

The back surface S1 of the housing 10 includes an access opening 11, which provides access to the driver circuit 200. The dimensions of the access opening 11 is selected to allow for a physical electrically conductive pathway to extend therethrough to the driver circuit 200 to provide for connection between the driver circuit 200 that is present in the housing 10 and the wireless control module 40 that is connected to the knock out 31 of the junction box 30. As will be described further herein, the driver circuit 200 can provide auxiliary power to the wireless control module 40 (which may also be referred to as an internet of things (IoT) module). The driver circuit may be 12 VDC, which can provide the auxiliary power for the wireless control module 40 and maintains the same form factor as a driver circuit 200 (downlight driver) for use in downlight type luminaires 100. On the back surface S1 of the downlight the access opening 11 is positioned that gives access to a connector in direct electrical communication with the driver circuit 200.

Figure 2:
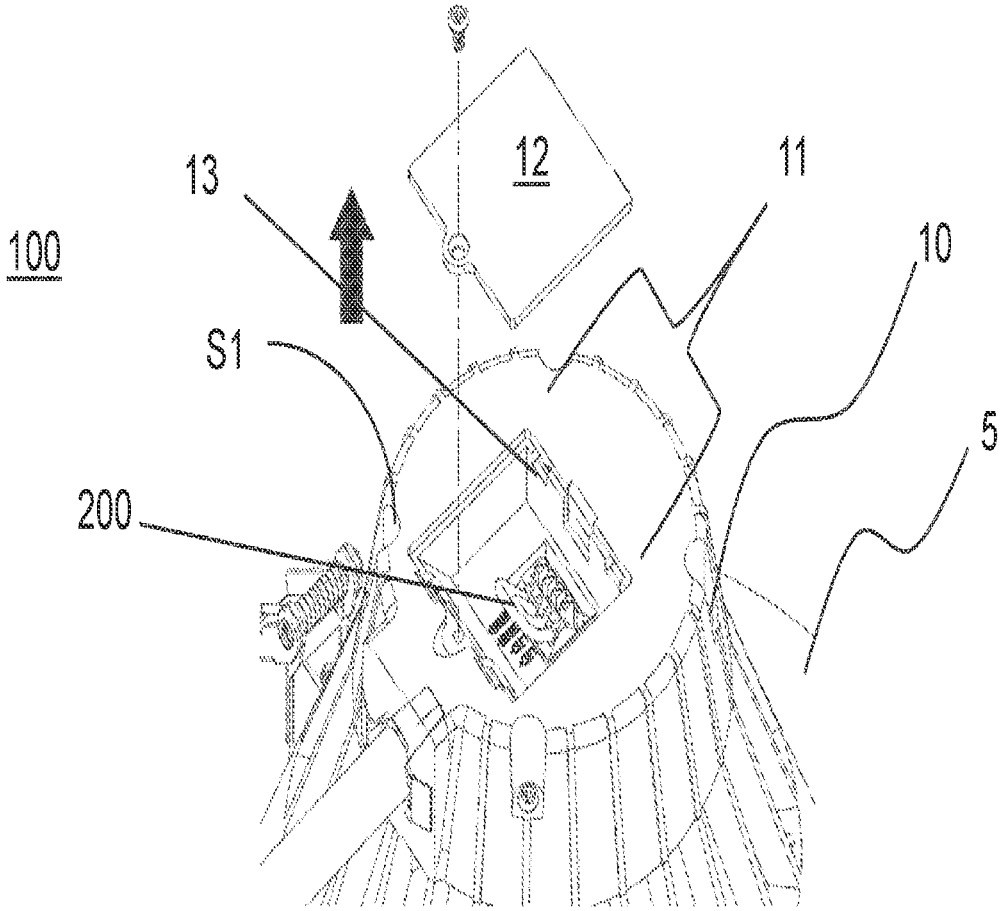
FIG. 2 is a perspective view of the luminaire depicted in FIG. 1 following removal of the access panel from the back surface of the downlight housing to expose the driver electronics of the luminaire.

Referring to FIGS. 1 and 2, an access door 12 may be reversibly engaged to the portion of the back surface S1 of the housing 10 that includes the access opening 11. The "back surface" S1 is the surface of the housing 10 that is opposite the end of the housing 10/luminaire 100 at which light is emitted. The back surface S1 is an exterior surface, and may have at least one planar portion. The term "reversibly engaged" means that the two structures that are engaged may be connected together and disconnected from being in contact with each other. In some embodiments, the connector and the driver circuit 200 are present within the housing 10. When it is not desired to include wireless control and/or internet of things (IoT) capabilities, e.g., the wireless control module 40 is not present in the luminaire 100, the access door 12 may be engaged to the back surface S1 of the housing 10 closing the access opening 11 and encapsulating the driver circuit 200 (as well as the connector) within the housing 10. The access door 12 may be composed of a same or different material as the housing 10. The access door 12 may be engaged to the housing using snap fit engagement. A "snap-fit" (Integral Attachment Feature) engagement is an assembly method used to attach flexible parts, usually plastic, to form the final product by pushing the parts' interlocking components together. The type of snap fit engagement employed to connect the access door 12 to the back surface S1 of the housing 10 to close the access opening 11 may be any type of snap fit engagement, including cantilever, torsional and annular. The access door 12 may also be engaged to the back surface S1 of the housing 10 using nut and bolt arrangements. Both the connector and the driver circuit 200 that is exposed by removing the access door 12 providing the access opening 11, may be encapsulating within the housing 10 by closing the access opening 12 through the installation of the access door 12.

The light engine 60 (also referred to as light source) is positioned within the housing 10 and orientated to emit light in a direction through opening of the housing 10 at which the trim 5 is positioned. The light engine produces light from solid state emitters. The term "solid state" refers to light emitted by solid-state electroluminescence, as opposed to incandescent bulbs (which use thermal radiation) or fluorescent tubes, which use a low pressure Hg discharge.

Figure 11A:
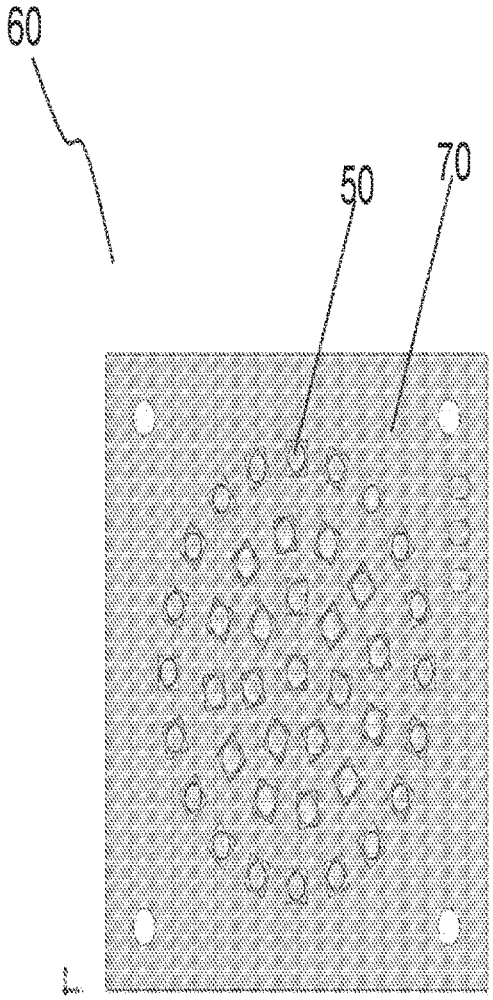
FIG. 11A is a top down view of a light engine including at least one string of light emitting diodes (LEDs) as used in the luminaire designs depicted in FIGS. 1-10B.
Figure 11B:
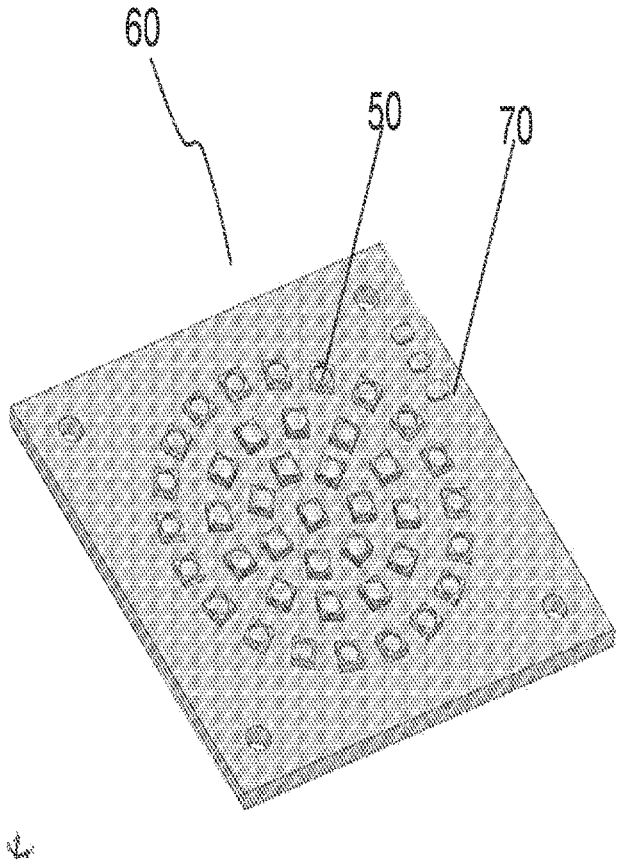
FIG. 11B is a perspective view of the light engine depicted in FIG. 11A.

Compared to incandescent lighting, solid state lighting creates visible light with reduced heat generation and less energy dissipation. Some examples of solid state light emitters that are suitable for the methods and structures described herein include inorganic semiconductor light-emitting diodes (LEDs), organic light-emitting diodes (OLED), polymer light-emitting diodes (PLED) or combinations thereof. Although the following description describes an embodiment in which the solid-state light emitters are provided by light emitting diodes, any of the aforementioned solid-state light emitters may be substituted for the LEDs. FIGS. 11A and 11B illustrate one example of the light emitting diodes (LEDs) 50 of a light engine 60 that can be utilized within the downlights 100 that are depicted in FIGS. 1-3 and 6-10B.

Referring to FIGS. 11A and 11B, in some embodiments, the light source (also referred to as light engine) for the downlight 100 is provided by plurality of LEDs 50 that can be mounted to the circuit board 60 by solder, a snap-fit connection, or other engagement mechanisms. In some examples, the LEDs 50 are provided by a plurality of surface mount device (SMD) light emitting diodes (LED). The circuit board 70 for the light engine 60 may be composed of a metal core printed circuit board (MCPB). MCPCB uses a thermally conductive dielectric layer to bond circuit layer with base metal (Aluminum or Copper). In some embodiments, the MCPCB use either Al or Cu or a mixture of special alloys as the base material to conduct heat away efficiently from the LEDs thereby keeping them cool to maintain high efficacy.

It is noted that the number of LEDs 50 on the printed circuit board 70 may vary. For example, the number of LEDs 50 may range from 5 LEDs to 70 LEDs. In another example, the number of LEDs 50 may range from 35 LEDs to 45 LEDs. It is noted that the above examples are provided for illustrative purposes only and are not intended to limit the present disclosure, as any number of LEDs 50 may be present the printed circuit board 70. In some other examples, the number of LEDs 50 may be equal to 5, 10, 15, 20, 25, 30, 35, 40, 45, 50, 55, 60, 65 and 70, as well as any range of LEDs 50 with one of the aforementioned examples as a lower limit to the range, and one of the aforementioned examples as an upper limit to the range.

The LEDs 50 may be arranged as strings on the printed circuit board 70. When referring to a "string" of LEDs it is meant that each of the LEDs in the string are illuminated at the same time in response to an energizing act, such as the application of electricity from the driving electronics, e.g., driver, in the downlight 100. The LEDs 50 in a string of LEDs are electrically connected for this purpose. For example, when a string of LEDs 50 is energized for illumination, all of the LEDs in the string are illuminated. Further, in some embodiments, illuminating the first string of LEDs 50 does not illuminate the LEDs in the second string of LEDs 50, and vice versa, as they are independently energized by the driving electronics, and not electrically connected. It is also noted that the same LED may be shared by more than one string.

In one embodiment, the LEDs 50 may be illuminated to provide an intensity of light emitted by the light engine 60 for the downlight 100 that can range from 300 lumens (LM) to 1500 lumens (LM). In some other examples, the LEDs 50 of the light engine 60 may illuminated to provide an intensity of light that is equal to 350 lumens (LM) 500 lumens (LM), 550 lumens (LM), 700 lumens (LM), 750 lumens (LM), 1200 lumens (LM), 5000 lumens (LM), as well as any range of intensity values included one of the aforementioned values for the lower end of the range, and one of the aforementioned values for the upper end of the range. The intensity of the light emitted by the light engine 60 is one characteristic of light emitted by the luminaire 100 that can be controlled by wireless controls, e.g., by integration of the wireless control module 40 into the luminaire structure 100. Decreases in the intensity of light being emitted by the light engine may be referred to as adjusting the dimming performance of the light emitted by the LEDs 50 of the light engine 60.

In some embodiments, the LEDs 50 of the luminaire 100 are selected to be capable of being adjusted for the color of the light they emit. The term "color" denotes a phenomenon of light or visual perception that can enable one to differentiate objects. Color may describe an aspect of the appearance of objects and light sources in terms of hue, brightness, and saturation. Some examples of colors that may be suitable for use with the method of controlling lighting in accordance with the methods, structures and computer program products described herein can include red (R), orange (O), yellow (Y), green (G), blue (B), indigo (I), violet (V) and combinations thereof, as well as the numerous shades of the aforementioned families of colors. It is noted that the aforementioned colors are provided for illustrative purposes only and are not intended to limit the present disclosure as any distinguishable color may be suitable for the methods, systems and computer program products described herein. The color of the light emitted by the light engine 60 is one characteristic of light emitted by the luminaire 100 that can be controlled by wireless controls, e.g., by integration of the wireless control module 40 into the luminaire structure 100.

The LEDs 50 of the luminaire 100 may also be selected to allow for adjusting the "color temperature" of the light they emit. The color temperature of a light source is the temperature of an ideal black-body radiator that radiates light of a color comparable to that of the light source. Color temperature is a characteristic of visible light that has applications in lighting, photography, videography, publishing, manufacturing, astrophysics, horticulture, and other fields. Color temperature is meaningful for light sources that do in fact correspond somewhat closely to the radiation of some black body, i.e., those on a line from reddish/orange via yellow and more or less white to blueish white. Color temperature is conventionally expressed in kelvins, using the symbol K, a unit of measure for absolute temperature. Color temperatures over 5000 K are called "cool colors" (bluish white), while lower color temperatures (2700-3000 K) are called "warm colors" (yellowish white through red). "Warm" in this context is an analogy to radiated heat flux of traditional incandescent lighting rather than temperature. The spectral peak of warm-colored light is closer to infrared, and most natural warm-colored light sources emit significant infrared radiation. The LEDs 50 of the luminaires provided by the present disclosure in some embodiments can be adjusted from 2000K to 7000K. In some embodiments, the color temperatures that can be emitted by the LEDs 50 of the light engine 60 can be equal to 3000K, 3500K, 4000K or 5000K. The color temperature of the light emitted by the light engine 60 is one characteristic of light emitted by the luminaire 100 that can be controlled by wireless controls, e.g., by integration of the wireless control module 40 into the luminaire structure 100.

In some embodiments, the LED light engines 60 for the downlight may provide the that downlight be an SMD (Surface Mount Diode) downlight and/or a COB (Chip on Board) downlights. In some embodiments, the LEDs 50 may be selected to be SMD type emitters, in which the SMDs are more efficient than COBs because the light source produces higher lumens per watt, which means that they produce more light with a lower wattage. In some embodiments, the SMD type LEDs 50 can produce a wider beam of light which is spread over a greater area when compared to light engines of COB type LEDs. This means that less material is needed for the heat sink, which in turn means that they are more economical. SMD downlights can be covered with a frosted reflector which hides the LED chip array, and spreads the light evenly. SMD downlights can produce a wide spread of light. In some example, the wide beam angle of the light emitted from SMD downlights means they can be suitable for larger rooms like living rooms, bedrooms, kitchens and bathrooms.

A Chip On Board (COB) LED Downlight consists of a single LED chip, mounted on the downlight, compared to an array of LED's like an SMD. COB LEDs are basically multiple LED chips (typically nine or more) bonded directly to a substrate by the manufacturer to form a single module. The ceramic/aluminum substrate of COB LEDs also acts as a higher efficiency heat transfer medium when coupled to an external heatsink, further lowering the overall operating temperature of the assembly. Since the individual LEDs used in a COB are chips, the chips can be mounted such that they take up less space and the highest potential of the LED chips can be obtained. When the COB LED package is energized, it appears more like a lighting panel than multiple individual lights as would be the case when using several SMD LEDs mounted closely together. In some embodiments, because the single cluster of LED's 50 are mounted in one point, they can require greater cooling, so a heat sink, usually made of aluminum, may be mounted to dissipate the heat.

A light engine of COB type LEDs 50 can provide a more focused light and with the use of reflectors, the light beam can be more controlled when compared to a light engine that is composed of SMD LEDs. Chrome reflectors surrounding the diode can be replaced and set at different angles to make the light beam narrower or wider. Due to the narrow beam and with the use of reflectors that are usually clear, COB lights generate crisper and cleaner as there is no frosting on the lenses, which cuts down the clarity of the LED light. Due to the clear lenses, more light can penetrate further which means they perform well in rooms with high ceilings.

It is noted that the above description of the light emitting diodes (LEDs) 50 is provided for illustrative purposes only, and is not intended to limit the present disclosure. For example, In some embodiments, other light sources may either be substituted for the LEDs 50, or used in combination with the LEDs 50, such as organic light-emitting diodes (OLEDs), a polymer light-emitting diode (PLED), and/or a combination of any one or more thereof.

Figure 3:
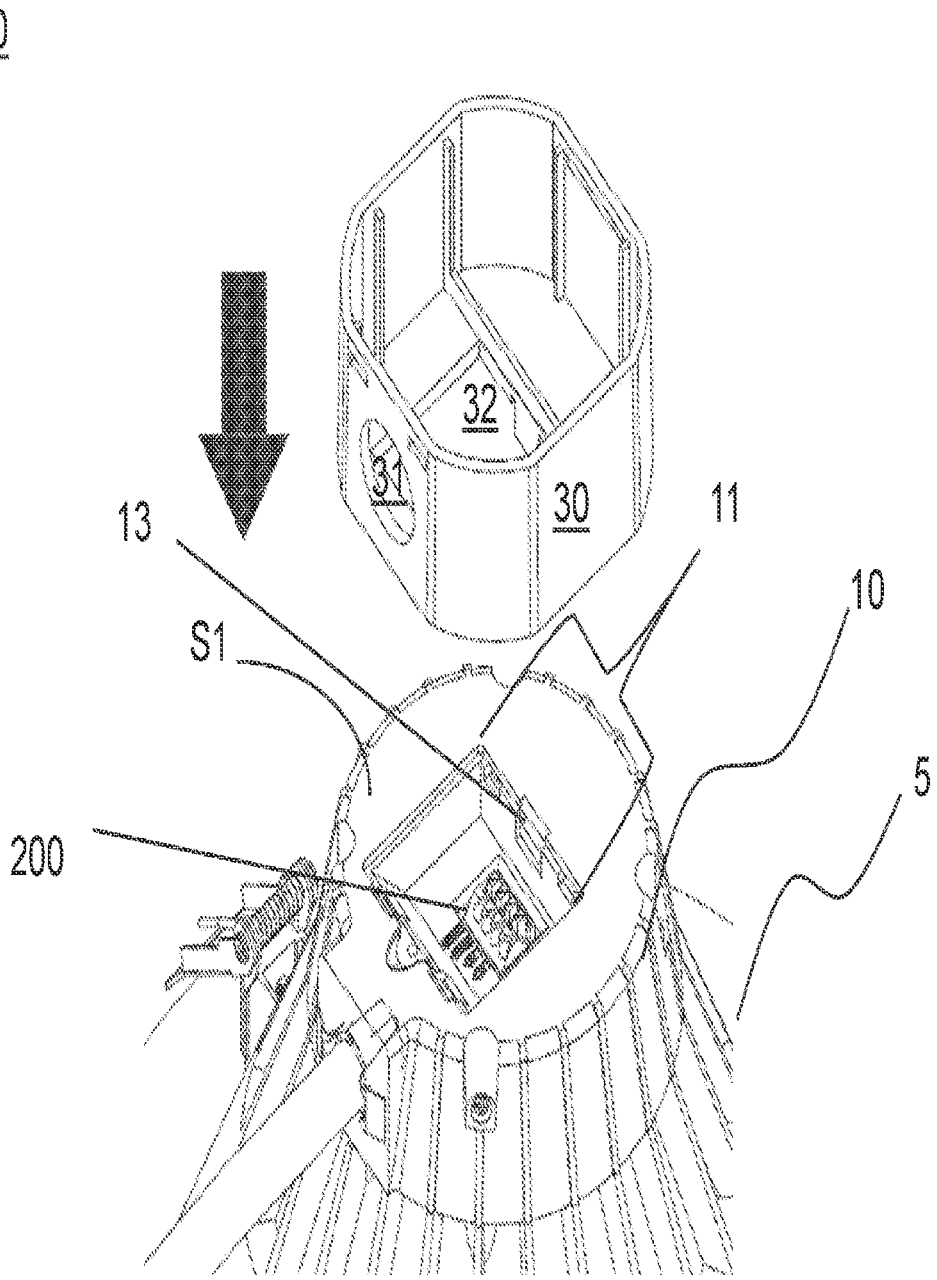
FIG. 3 is a perspective view of the luminaire depicted in FIG. 2 illustrating the engagement of the junction box to the back surface of the downlight housing after the access panel to the driver electronics has been removed, in accordance with one embodiment of the present disclosure.
Figure 6:
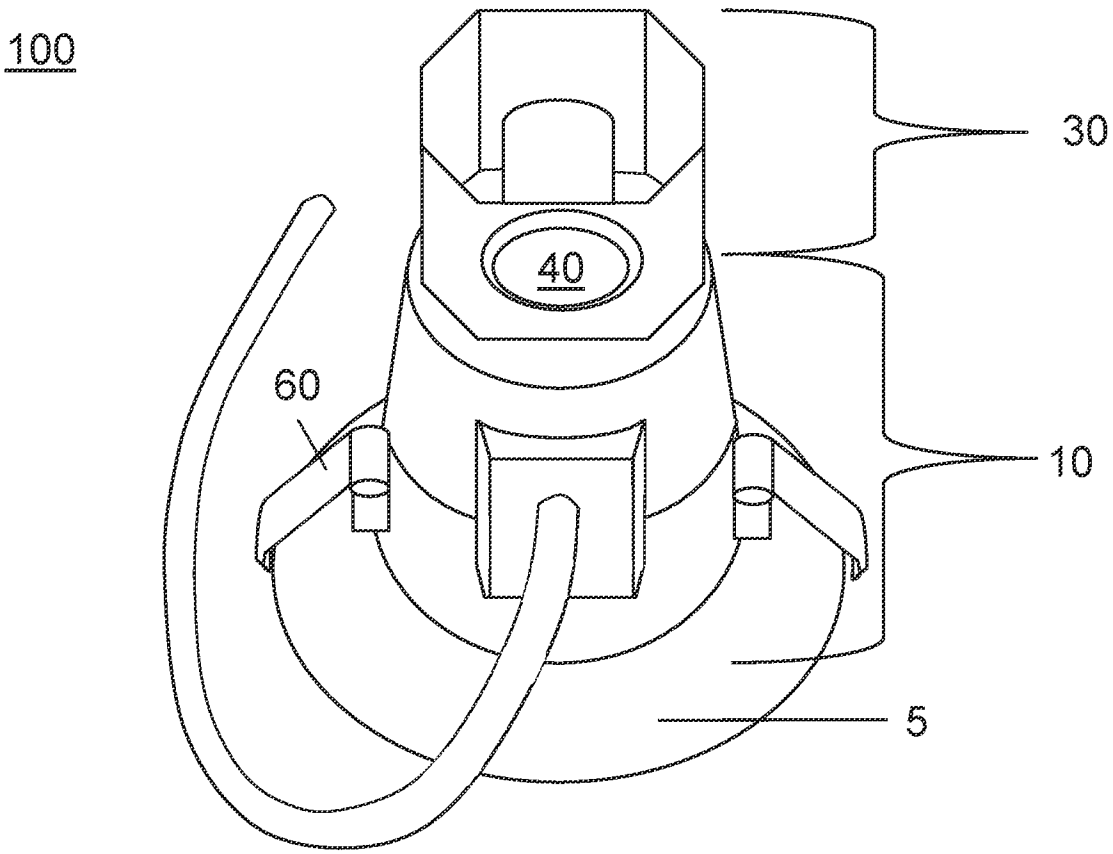
FIG. 6 is a perspective view of the wireless control module engaged to the junction box, in which the junction box is engaged to the back surface of the luminaire housing body, and the wireless control module is in electrical communication and/or electrical connections to the driver electronics of the luminaire through the access opening that is exposed by removing the access panel, in accordance with one embodiment of the present disclosure.
Figure 9:
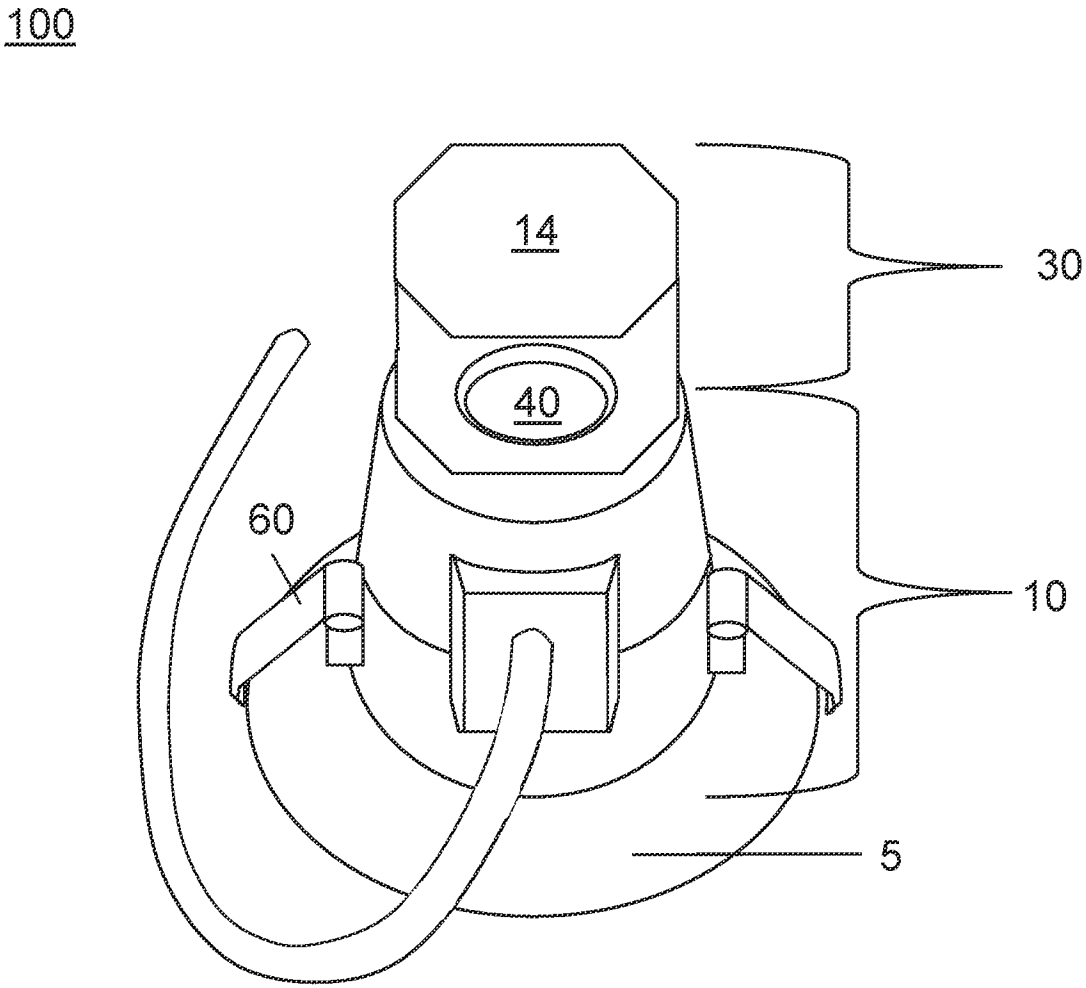
FIG. 9 is a perspective view of one embodiment of a cover being engaged onto the junction box.
Figure 10B:
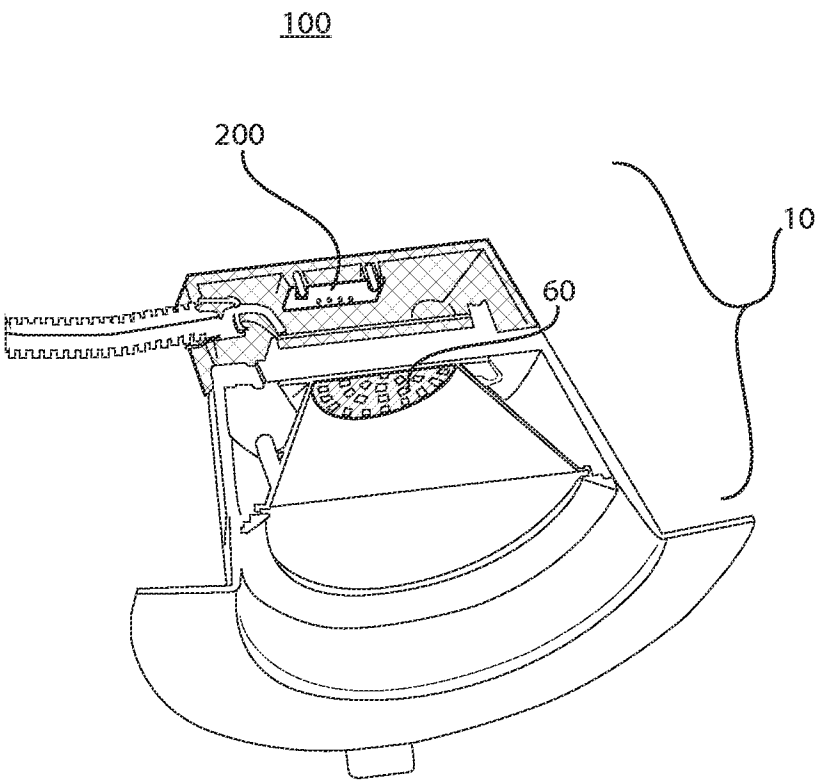
FIG. 10B is a cross-sectional view of the luminaire design depicted in FIG. 10A.
Figure 10A:
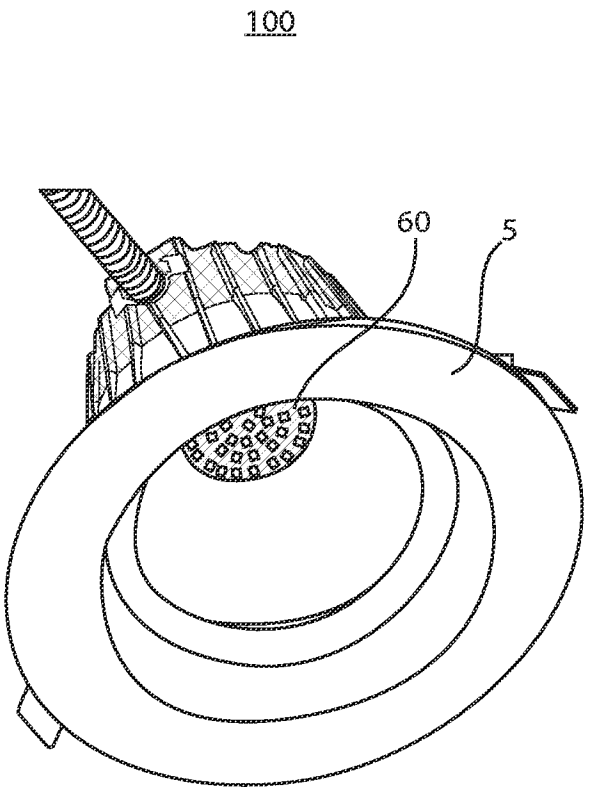
FIG. 10A is a perspective view of a downlight geometry luminaire that has been tilted to depict the light engine including at least one string of light emitting diodes, in accordance with one embodiment of the present disclosure.

Referring to FIGS. 3, 6 and 9, a connector is present within the housing 10 for electrical connection with the driver circuit 200. In one embodiment, the connector provides for electrical communication of power, e.g., auxiliary power, from the driver circuit 200 to the wireless control module 40, and can provide for electrical communication of control signals, e.g., light dimming commands, between the wireless control module 40 and the driver circuit 200. The connector is accessible through the access opening 11 in the back surface S1 of the housing 10. It is noted that the sidewalls extending from the access opening 11 into the cavity that contains the driver circuit 200 may include snap features 13, e.g., receiving recesses for retaining tabs that can deform and deflect into engagement of the receiving recesses. In some embodiments, the snap features 13 may be employed to engage the access door 12 to the housing 10. In other embodiments, the snap features in the sidewalls extending from the access opening 11 into the cavity that contains the driver circuit 200 may contribute to engaging the junction box 30 to the back surface S1 of the housing 10.

The junction box 30 may include a knockout 31 having dimensions for engaging the wireless control module 40 and wiring opening 32 having dimensions to allow for physical electrical communication structures, such as wiring, to extend from the wireless control module 40 that is engaged to the knockout 31 through the wiring opening 32 into electrical communication, via contact, to the driver circuitry 200. The knockout 31 is present in a sidewall of the junction box 30. The wiring opening 32 is present at a base of the junction box 30.

The junction box 30 may be composed of a metal, such as aluminum (Al). In some embodiments, the junction box 30 may also be composed of a plastic, such a polycarbonate. The material that provides the junction box 30 may be the same composition or a different composition from the material that provides the housing 10.

The junction box 30 can be engaged, e.g., reversibly engaged, to the back surface S1 of the housing 10 by snap-fit engagement. For example, the junction box 30 may include engagement members for engaging, e.g., reversibly engaging, the snap features 13, e.g., receiving recesses, of the housing 10. The engagement features of the junction box 30 may be selected depending upon the type of snap-fit engagement being used between the junction box 30 and the housing 10. Three examples of snap-fit engagement suitable for joining the junction box 30 and the housing 10 can include annular snap fit engagement, cantilever snap fit engagement, and torsional snap fit engagement. Snap-fit joints have a design that includes a protruding edge and a snap-in area. The annular snap-fit utilizes hoop-strain to hold into place. Hoop-strain is the expansion of the circumference of the more elastic piece as it is pushed onto the more rigid piece. In most cases the design is circular. This kind of snap-fit can be used multiple times. A cantilever design can be multiple use or permanent. A multiple use snap-fit usually has a lever or pin to be pushed, in order to undo the snap-fit. However, on a permanent snap-fit there is no lever or pin. In a torsional snap fit, one must deflect, or force the protruding edges of a first piece away from the insertion area a second piece. The second piece then slides in between the protruding edges until the desired distance is reached. The edges of first piece is then released and the second piece is held in place. In some embodiments, the junction box 30 may include members having protruding edges to engage the snap features 13, e.g., receiving recesses, of the housing 10.

In other embodiments, the junction box 30 engages the back surface S1 of the housing 10 by nut and bolt arrangements or threaded fasteners.

In some embodiments, the wiring opening 32 that is present through the base of the junction box 30 is substantially aligned to the access opening 11 in the housing 10 to provide that a passageway extends from the cavity containing the driver circuits 200 through the wiring opening 32 of the base of the junction box 30.

The knockout 31 is present through the sidewall of the junction box 30. The knockout 31 is an opening having a geometry for engagement to the wireless control module 40. For example, if the portion of the wireless control model 40 that is engaged to the junction box 30 has a substantially circular cross section, the opening that provides the knockout 31 also has a substantially circular cross section. The dimensions of the knockout 31 may be selected to provide for a friction fit engagement with the wireless control model 40. In some embodiments, the dimensions and geometry of the knockout 31 can be selected to work with the wireless control module 40 to provide for a snap fit engagement between the knockout 31 and the wireless control module 40. The engagement of the knockout 31 and the wireless control module 40 can be reversible.

Figure 4A:
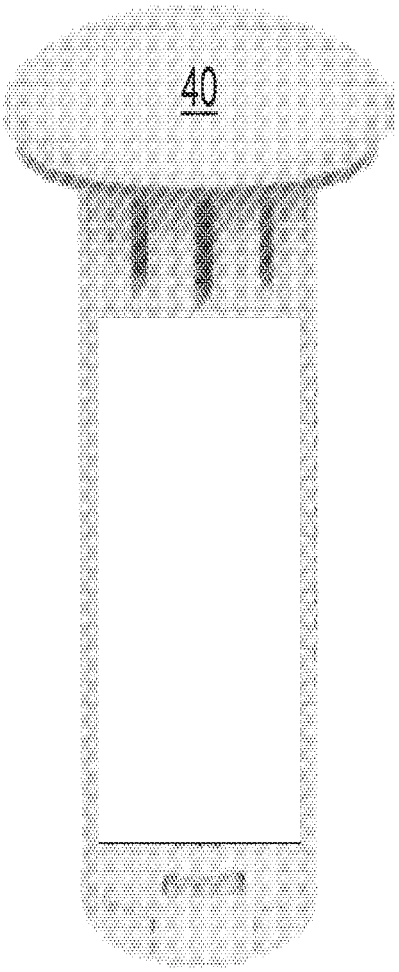
FIGS. 4A and 4B are perspective views of a wireless control module that can be reversibly engaged to the junction box depicted in FIG. 3 and is in electrical communication to the driver electronics of the luminaire, in accordance with one embodiment of the present disclosure.
Figure 4B:
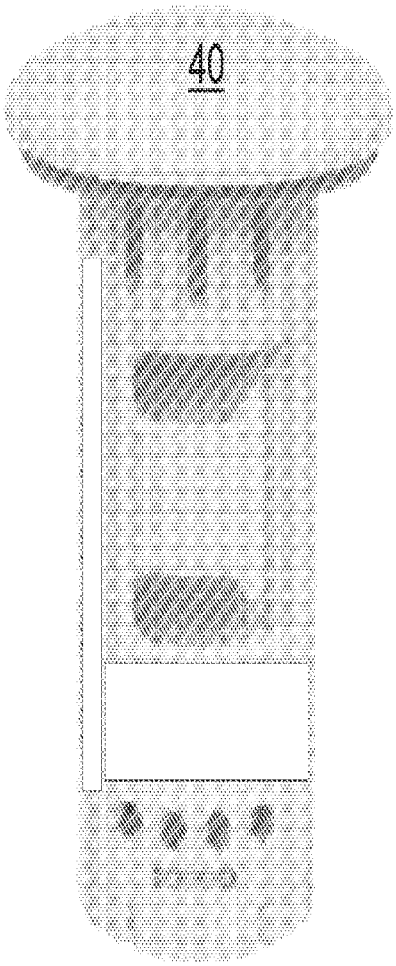
Figure 5A:
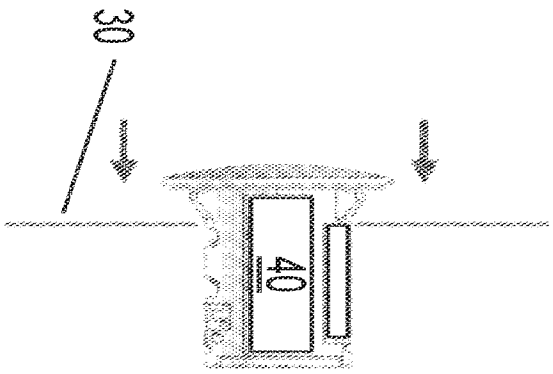
FIGS. 5A and 5B illustrate the snap in connection of a wireless control module into a knockout formed in the sidewall of the junction box, in accordance with one embodiment of the present disclosure.
Figure 5B:
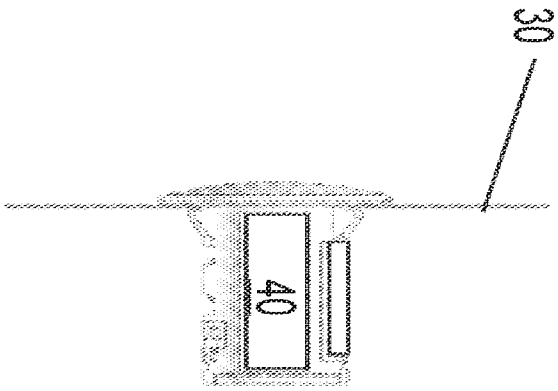

FIGS. 4A and 4B are perspective views of a wireless control module 40 that can be reversibly engaged to the junction box 30 depicted in FIG. 3, and is in electrical communication to the driver circuit 200 of the luminaire 100. The wireless control module 40 is connected to the driver circuit 200. The wireless control module 40 can be connected by wired connection to the driver circuit 200. The wireless control module 40 may provide at least one control function, such as dimming/intensity control of the light being emitted by the luminaire 100. In some other embodiments, the wireless control module 40 may provide other light control functions, such as ON/OFF switching. The wireless control module 40 may also be employed to control the color of light being emitted by the light engine 60. In some embodiments, the wireless control module 40 may also be employed to control the color temperature of light being emitted by the light engine 60. It is noted that the wireless control module 40 may have a modular design allowing for interchangeability with the junction box 30. In this manner, different control functionalities may be introduced to the luminaire 100. For example, the user can switch wireless control modules 40 from a control module that provides for dimming/intensity control of the light being emitted by the light engine 60 of the luminaire 100 to a control module that provides controllability of the light color temperature of the light being emitted by the light engine 60 of the luminaire 100. FIGS. 5A and 5B illustrate the snap in connection of a wireless control module 40 into a knockout formed in the sidewall of the junction box. This can be a reversible connection.

The wireless control module 40 in electrical communication with the driver electronics can also provide for wireless control by the user of the function being introduced to the luminaire 100 by the wireless control module 40. To provide that the luminaire 100 is controllable through wireless communication, like Bluetooth, Wi-Fi and ZigBee, the wireless control module 40 can include an RF module to receive commands from a user terminal device, which can be provided by a phone, a tablet or even voice control device like Alexa™ and Google™ home, so that the user can control the lighting characteristics of the luminaire 100 remotely.

The wireless capabilities employed through the wireless control module 40 can be based upon IEEE 802.11, which is for wireless LANs (WLANs), also known as Wi-Fi. The 802.15 group of standards specifies a variety of wireless personal area networks (WPANs) for different applications. For instance, 802.15.1 is Bluetooth, 802.15.3 is a high-data-rate category for ultra-wideband (UWB) technologies, and 802.15.6 is for body area networks (BAN). The 802.15.4 category is probably the largest standard for low-data-rate WPANs. It has many subcategories. The 802.15.4 category was developed for low-data-rate monitor and control applications and extended-life low-power-consumption uses. The basic standard with the most recent updates and enhancements is 802.15.4a/b, with 802.15.4c for China, 802.15.4d for Japan, 802.15.4e for industrial applications, 802.15.4f for active (battery powered) radio-frequency identification (RFID) uses, and 802.15.4g for smart utility networks (SUNs) for monitoring the Smart Grid. All of these special versions use the same base radio technology and protocol as defined in 802.15.4a/b. These wireless standards can be provided to the luminaire 100 via the wireless control module 40 being wired to the driver circuit 200.

Zigbee technologies, and similar standards based on the IEEE 802 standard for networking, can be used for wireless based smart lighting control. ZigBee can be an enhancement to the 802.15.4 standard. These enhancements include authentication with valid nodes, encryption for security, and a data routing and forwarding capability that enables mesh networking. The Zigbee standard can be provided to the luminaire 100 via the wireless control module 40 being wired to the driver circuit 200.

Bluetooth Low Energy (BLE) (aka "Bluetooth smart") is another standard in the wireless smart control business. Bluetooth low energy (BLE) is generally packaged with Bluetooth classic. The bluetooth wireless standard can be provided to the luminaire 100 via the wireless control module 60 being wired to the driver circuit 200. It is noted that the communication standards suitable for the wireless control module 40 are not limited to only the examples described herein, as any wireless communication standard is applicable to the wireless control module 60. For example, protocols may further include wireless communication protocols over 434 MHz.

It is noted that the wireless control module 40 may have a modular design allowing for interchangeability with the junction box 30. In this manner, different wireless communications protocols may be introduced to the luminaire 100. For example, the user can switch wireless control modules 40 from a control module that provides a Zigbee wireless communication protocol to the luminaire 100 to a control module that provides a Bluetooth/BLE wireless communication protocol of the luminaire 100. FIGS. 5A and 5B illustrate the snap in connection of a wireless control module 40 into a knockout formed in the sidewall of the junction box. This can be a reversible connection.

The lighting characteristics/lighting adjustments that are controlled by the wireless control module 40 through commands received wirelessly from a controller device. The controller device may be a mobile computing device, laptop/notebook computer, sub-notebook computer, a tablet, phablet computer; a mobile phone, a smartphone; a personal digital assistant (PDA), a portable media player (PMP), a cellular handset; a handheld gaming device, a gaming platform, a wearable computing device, a body-borne computing device, a smartwatch, smart glasses, smart headgear, and a combination thereof. In some embodiments, the method, structures and systems of the present disclosure can employ building control hubs. In this example, the wireless control module 40 can communicate with the building control hubs, and the building control hub communicates to a mobile device, such as a table, computer, phone, etc. In other examples, the wireless control module 40 may communicate through building automation through BACnet or similar means. In yet other embodiments, the lighting characteristics/lighting adjustments are controlled by the wireless control module 40 that receives commands from a voice control device, such as Alexa™ and Google™ home.

Figure 8:
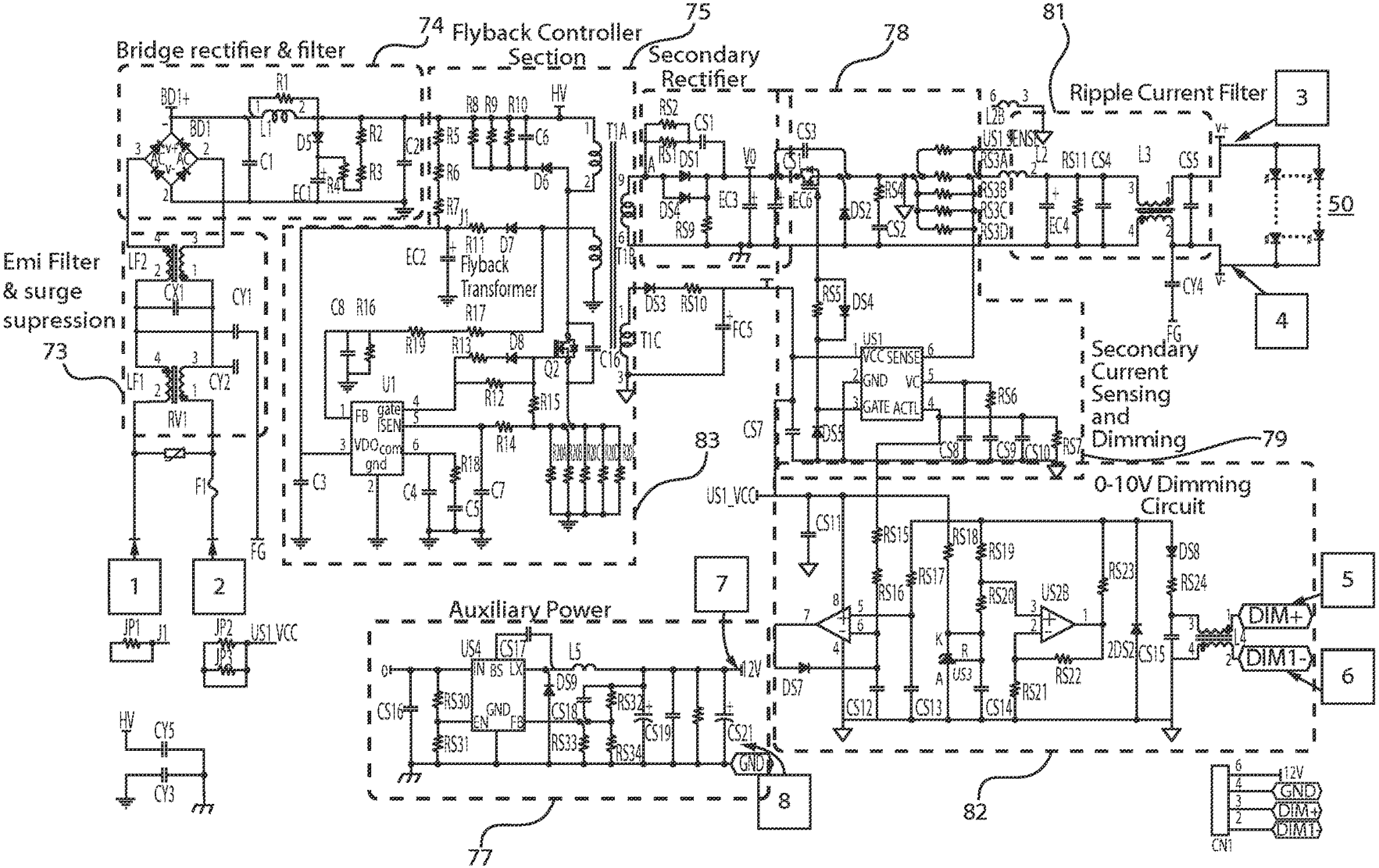
FIG. 8 is a circuit diagram of the driver electronics within the luminaire housing body including the portion of the driver electronics that is exposed by removal of the access panel, in accordance with one embodiment of the present disclosure.

In some embodiments, the junction box 30 is snapped into engagement with the back surface S1 of the housing, the wireless control module 40 is engaged to the knockout 31 of the junction box 30, and the wireless control module 40 is connected, e.g., by physical wiring, to the driver circuit 200. FIG. 8 depicts one embodiment of a wireless control module 40 that is engaged to the junction box 30, in which the junction box 30 is engaged to the back surface S1 of the luminaire housing body 10, and the wireless control module 40 is in electrical communication and/or electrical connections to the driver circuit 200 of the luminaire 100 through the access opening 11 that is exposed by removing the access panel 12. Following connection of the wireless control module 40 to the driver circuit 200

Figure 7:
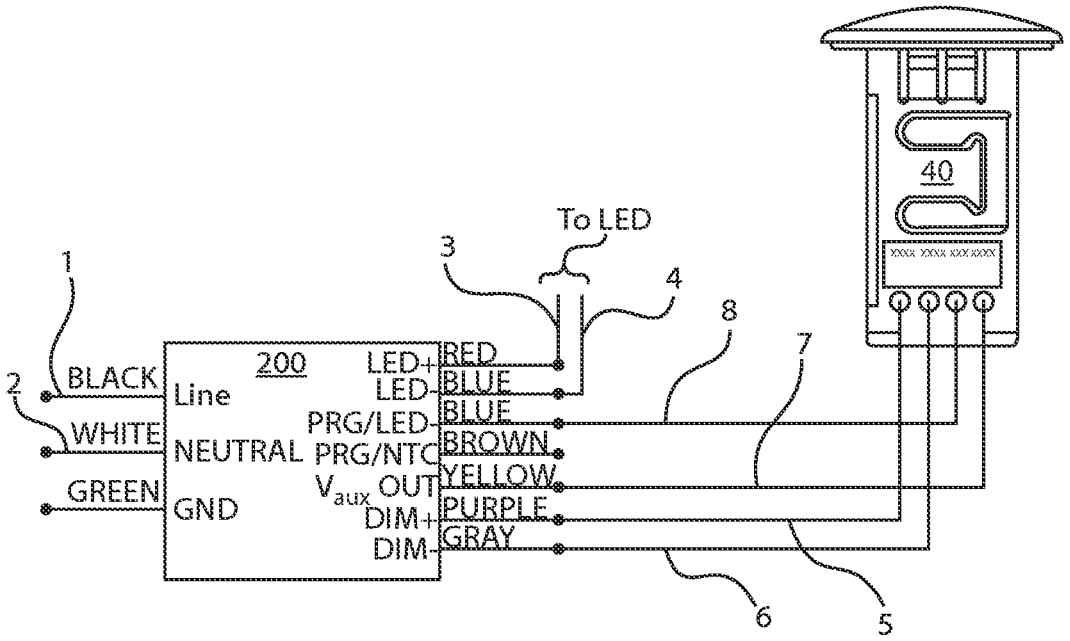
FIG. 7 is a circuit diagram illustrating the electrical connectivity of the wireless control module to the driver electronics of the luminaire, in accordance with one embodiment of the present disclosure.

FIG. 7 is a circuit diagram illustrating the electrical connectivity of the wireless control module 40 to the driver circuit 200 of the luminaire 100. FIG. 8 is a circuit diagram of the driver circuit 200 within the luminaire housing body 200 including the portion of the driver circuit 200 that is exposed by removal of the access panel 12. The connections between the circuit diagram depicted in FIG. 8 for the driver circuit 200 and the circuitry for the wireless control module 40 depicted in FIG. 7 is indicated by matching reference numbers. For example, reference number 1 for the wiring of the circuit depicted in FIG. 7 connects to reference number 1 of the wiring of the circuit depicted in FIG. 8. For example, reference number 2 for the wiring of the circuit depicted in FIG. 7 connects to reference number 2 of the wiring of the circuit depicted in FIG. 8. For example, reference number 3 for the wiring of the circuit depicted in FIG. 7 connects to reference number 3 of the wiring of the circuit depicted in FIG. 8. For example, reference number 4 for the wiring of the circuit depicted in FIG. 7 connects to reference number 4 of the wiring of the circuit depicted in FIG. 8. For example, reference number 5 for the wiring of the circuit depicted in FIG. 7 connects to reference number 5 of the wiring of the circuit depicted in FIG. 8. For example, reference number 6 for the wiring of the circuit depicted in FIG. 7 connects to reference number 6 of the wiring of the circuit depicted in FIG. 8. For example, reference number 7 for the wiring of the circuit depicted in FIG. 7 connects to reference number 7 of the wiring of the circuit depicted in FIG. 8. For example, reference number 8 for the wiring of the circuit depicted in FIG. 7 connects to reference number 8 of the wiring of the circuit depicted in FIG. 8.

Figure 12:
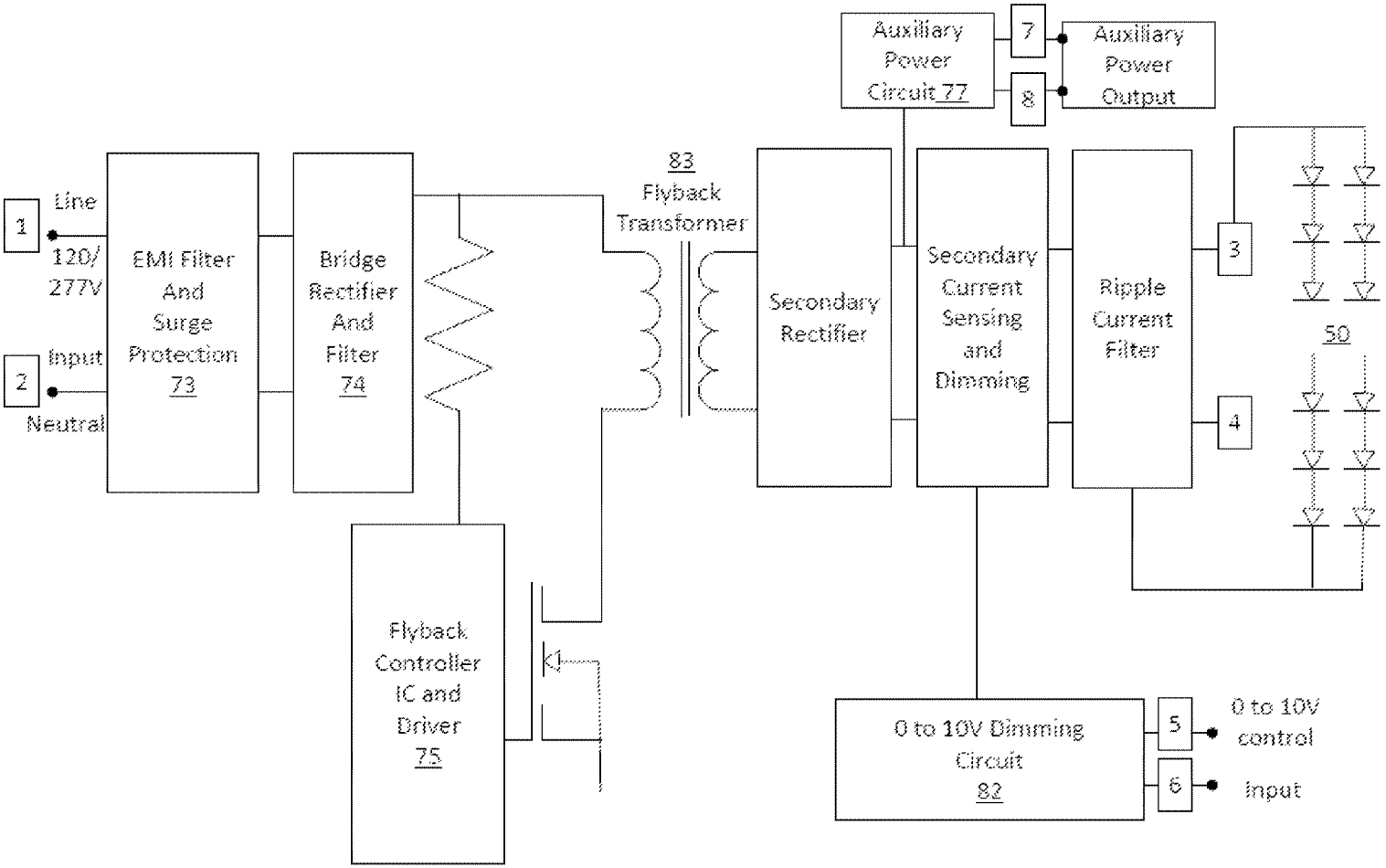
FIG. 12 is a block diagram of at least a portion of the driver circuitry including an isolated flyback topology with primary side controller, in accordance with one embodiment of the present disclosure.

Referring to FIGS. 7, 8 and 12, in some embodiments the electronics package 200 for the downlight 100 may further include: EMI filter and surge protection circuit 73, bridge rectifier and filter circuit 74, flyback controller circuit 75, flyback transformer circuit 83, secondary rectifier circuit 78, ripple current filter circuit 81, secondary current sensing and dimming circuit 79, 0V-10V dimming circuit 82, LED strings 50 and auxiliary power circuit 77.

The EMI filter and surge protection 73 portion of the electronics package 200 includes an EMI filter to filter the high frequency noise generated by the flyback converter from entering the mains input terminals of line and neutral. The surge protector protects the luminaire from the surge caused by events such as lightning and disturbances on the mains grid. The Surge protector absorbs the energy and limits the peak voltage to a safe level.

The bridge rectifier and filter 74 portion of the electronics package 200 includes a bridge rectifier that rectifies the AC input voltage into a pulsating DC voltage. The filter filters the high frequency noise.

The flyback converter 75 portion of the electronics package 200 contains the flyback transformer, switch, flyback controller, starting resistor, secondary rectifier and ripple current filter. This section of the electronics package 200 generates the required voltage and current as per the need of the LED strings 50. This section also provides the necessary isolation between the input and output.

The secondary current sensing and dimming circuit 79 can sense the output current and get a signal form the dimming circuit to change the output current, through a switching scheme.

The 0 to 10V dimming circuit 82 is the section accepts the input from the 0 to 10V dimmer and generates corresponding signal for the Secondary Current Sensing and Dimming. This enables the change of output current from power supply going into LEDs to be controlled by the external 0 to 10V dimmer.

The 0-10V dimming circuit 82 is in electric communication with a 0-10V dimming wall switch. The 0-10V dimming circuit 82 is in electrical communication with the LEDs 50. The 0-10V dimming circuit 71 may be referred to as a 0-10 dimmable LED driver. In lighting control applications, "0-10" describes the use of an analog controller to adjust the voltage in a 2-wire (+10 VDC and Common) bus connecting the controller to one or more LED drivers equipped with a 0-10 VDC dimming input. A 0-10 dimmable LED driver includes a power supply circuit that produces approximately 10 VDC for the signal wires and sources an amount of current in order to maintain that voltage. The controlled lighting should scale its output so that at 10 V, the controlled light should be at 100% of its potential output, and at 0 V it should at the lowest possible dimming level.

A 0-10V LED dimmable driver designs with a control chip. The 0-10V voltage changes, the power supply output current will change. For example, when the 0-10V dimming signal modulates to 0V, the output current will be 0, the brightness of the light will be off; when the 0-10V dimming modulates to maximum 10V, the output current will reach 100% power output, the brightness will be 100%.

The LED string 50 portion of the electronics package 200 includes the circuitry to the number of LEDs, and the number of LED strings. The LED type, e.g., color temperature, can be chosen based on the requirement for the light output characteristics. These LED strings are driven by the voltage and current generated by the flyback converter and they generate the required optical characteristics.

The auxiliary power circuit 77 provides the required power to an accessory, such as the wireless control module 40, e.g., an IOT module. It can be, for example, a 12V dc power supply.

Referring to FIG. 8, in some embodiments, the driver 200 may be a single-channel or multi-channel electronic driver configured to drive the solid state light emitters, e.g., LEDs, utilizing pulse-width modulation (PWM) dimming or any other suitable standard, custom, or proprietary driving techniques. As further shown in FIG. 8, the driver 200 may include a controller.

FIG. 9 is a perspective view of one embodiment of a cover 14 being engaged onto the junction box. The engagement of the cover 14 to the junction box 30 may be by snap fit engagement. The engagement of the cover 14 to the junction box 30 can be reversible.

In another aspect, a lighting method is provided. The method of adding wireless control to a luminaire 100 may include exposing driver circuitry 200 through a back surface S1 of a housing 10 for a luminaire 100 having a downlight geometry, wherein the housing 10 contains a light engine 60 including at least one light emitting diode (LED) 50 that is positioned to emit light through a light emission end of the housing 10. The driver circuitry 200 controls power received by the luminaire 100 for powering the light engine 60. The method may further include engaging a junction box 30 having a knockout 31 for a wireless control module 40 and a wiring opening 32 to the back surface S1 of the housing 10. The method may further include connecting wiring from the wireless control module 40 to the driver electronics 200 and the wireless control module 40, in which the wiring passes through the wiring opening 32 of the junction box 30.

In some embodiments, the junction box 30 engages to the back surface S1 of the housing 10 by snap fit engagement, wherein the snap fit engagement is selected from the group consisting of cantilever snap fit, annular snap fit, torsional snap fit or a combination thereof. In other embodiments, the junction box 30 engages the back surface S1 of the housing 10 by nut and bolt arrangements or threaded fasteners.

The physical electrically conductive pathway may include wiring that provides an auxiliary power source wiring from the driver circuit 200 to the wireless control module 40, and control wiring for controlling at least one function of the luminaire 100. In one embodiments, the at least one function of the luminaire 100 being controlled through the control wiring to the wireless control module 40 is light dimming.

In some embodiments, the connection/sensor to the luminaire could be placed on the flex cable. Additionally, instead of a junction box, a module with integrated wireless capability having snap fit capability can be connected to the back surface of the housing. In other embodiments, the downlight driver can be provided with Dexal or SR (sensor ready) Connection (2 way communication) instead of an auxiliary power and 0-10V dimming connection to enable power and temperature monitoring and other IoT functionalities. Additionally, other accessories requiring low voltage supply. (e.g. Wi-Fi repeater, smoke detector, etc.) can be integrated into the luminaire.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS.

Having described preferred embodiments of an INTERNET OF THINGS ADAPTABLE DOWNLIGHT, it is noted that modifications and variations can be made by persons skilled in the art considering the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A luminaire comprising:

a housing containing a light engine for projecting light through a front side of the housing, wherein the housing contains driver electronics for controlling power received by the luminaire for powering the light engine, a main power line connection to the driver electronics extending through a sidewall of the housing containing the light engine, wherein an access opening is present through an exterior surface of a back side of the housing that is opposite the front side of the housing; and a junction box that is engaged to the exterior surface of the back side of the housing having the access opening, the junction box having a control module and an electrical pathway opening, wherein electrical communication between the control module is across an electrically conductive pathway that extends through the access opening into connection with the driver electronics, wherein the main power line connection is outside the junction box containing the control module.

2. The luminaire of claim 1, wherein the light engine includes light emitting diodes (LEDs).

3. The luminaire of claim 1, wherein the exterior surface is a back surface or side surface of the housing.

4. The luminaire of claim 1, wherein the housing further comprises an access door that is present on the access opening.

5. The luminaire of claim 1, wherein the junction box engages to the exterior surface of the housing by snap fit engagement.

6. The luminaire of claim 5, wherein the snap fit engagement is selected from the group consisting of cantilever snap fit, annular snap fit, torsional snap fit or a combination thereof.

7. The luminaire of claim 1, wherein the junction box engages the exterior surface of the housing by nut and bolt arrangements or threaded fasteners.

8. The luminaire of claim 1, wherein the electrically conductive pathway comprises wiring, the wiring including an auxiliary power source wiring from the driver circuit to the wireless control module, and control wiring for controlling at least one function of the luminaire.

9. The luminaire of claim 8, wherein at least one function of the luminaire being controlled through the control wiring is light dimming.

10. A luminaire comprising:

a housing and a light engine including at light emitting diodes (LEDs), in which the light engine is positioned to emit light through a light emission end of the housing, the housing containing driver electronics for controlling power received by the luminaire for powering the light engine, wherein the luminaire includes an access opening on an exterior surface of the housing and a main power line connection; and a junction box containing a control module and a wiring opening, the junction box is reversibly engaged to an exterior surface of the housing, wherein electrical communication between the wireless control module is by wiring that extends from the control module through the wiring opening to the driver electronics, wherein the main power line connection is outside the junction box containing the control module.

11. The luminaire of claim 10, wherein the light emitting diodes are surface mount device (SMD) light emitting diodes (LED), chip on board (COB) light emitting diode or a combination thereof.

12. The luminaire of claim 10, wherein the exterior surface is a back surface or side surface of the housing.

13. The luminaire of claim 10, wherein the junction box being said reversibly engaged to the exterior surface of the housing is by snap fit engagement, wherein the snap fit engagement is selected from the group consisting of cantilever snap fit, annular snap fit, torsional snap fit or a combination thereof.

14. The luminaire of claim 10, wherein the wiring includes an auxiliary power source wiring from the driver circuit to the wireless control module, and control wiring for controlling at least one function of the luminaire, wherein the at least one function of the luminaire being controlled through the control wiring is light dimming.

15. A method of adding wireless control to a luminaire comprising:

exposing driver circuitry through an exterior surface of a housing for a luminaire, wherein the housing contains a light engine that is positioned to emit light through a light emission end of the housing and contains the driver circuitry to control power received by the luminaire for powering the light engine, wherein the housing for the luminaire includes a main power line connection;

engaging a junction box for supporting at least a portion of a control module to the exterior surface of the housing, the junction box having an electrical pathway opening, wherein the main power line connection is outside the junction box containing the control module; and providing an electrical pathway from the control module to the driver circuitry, in which the electrical pathway passes through the electrical pathway opening of the junction box.

16. The method of claim 15, wherein the exterior surface is a back surface or side surface of the housing.

17. The method of claim 15, wherein the junction box engages to the exterior surface of the housing by snap fit engagement, wherein the snap fit engagement is selected from the group consisting of cantilever snap fit, annular snap fit, torsional snap fit or a combination thereof.

18. The method of claim 15, wherein the junction box engages the exterior surface of the housing by nut and bolt arrangements or threaded fasteners.

19. The method of claim 15, wherein the physical electrically conductive pathway comprises wiring, the wiring including an auxiliary power source wiring from the driver circuit to the wireless control module, and control wiring for controlling at least one function of the luminaire.

20. The method of claim 19, wherein the at least one function of the luminaire being controlled through the control wiring is light dimming.

* * * * *